US005523817A

United States Patent [19]

Morita

[11] Patent Number: 5,523,817

[45] Date of Patent: Jun. 4, 1996

[54] PHOTOSENSITIVE MATERIAL PROCESSING APPARATUS

[75] Inventor: Satoshi Morita, Kanagawa, Japan

[73] Assignee: Fuji Photo Film Co., Ltd., Kanagawa, Japan

[21] Appl. No.: 474,752

[22] Filed: Jun. 7, 1995

[30] Foreign Application Priority Data

Jul. 27, 1994 [JP] Japan ..... 6-175741

[51] Int. Cl.[6] ..... G03D 3/08

[52] U.S. Cl. ..... 354/319; 354/321; 354/339

[58] Field of Search ..... 354/339, 319, 354/320, 321; 492/24, 25, 28, 38

[56] References Cited

U.S. PATENT DOCUMENTS 3,625,130 12/1971 Allen et al. ..... 354/304
3,916,426 10/1975 Bown ..... 354/319

FOREIGN PATENT DOCUMENTS 3921664 7/1939 Japan .
1205166 8/1989 Japan ..... G03D 3/13
4502518 5/1992 Japan ..... G03B 31/00
4109758 9/1992 Japan ..... G03C 3/00

*Primary Examiner*—D. Rutledge
*Attorney, Agent, or Firm*—Sughrue, Mion, Zinn, Macpeak & Seas

[57] ABSTRACT

A photosensitive material processing apparatus is provided in which the structure thereof is simple, a plurality of types of photosensitive materials can be reliably guided in accordance with the width of the photosensitive material to be conveyed, and the guide width changing operation can be easily effected. A wide film F1 can receive driving force in a state in which the film F1 is nipped between a collar portion 50 having a larger diameter and a circumferential surface of a roller 26. Because side plates 20, 22 serve as width guides of the film F1, the film F1 is stably conveyed. In a case in which a narrow film F2 is processed, a bearing 32 is moved so that a protruding portion 46 of the bearing 32 is inserted through a concave portions 48 which is located closer to the roller 26. Accordingly, the collar portion 50 is accommodated within a groove portion 54, and a collar portion 52 having a smaller diameter contacts the circumferential surface of the roller 26 so that the narrow film F2 is nipped between the circumferential surface of the collar portion 52 and the roller 26. Further, the end surface of the collar portion 50 having a larger diameter serves as a guide. Therefore, the narrow film F2 can also be stably conveyed.

20 Claims, 8 Drawing Sheets

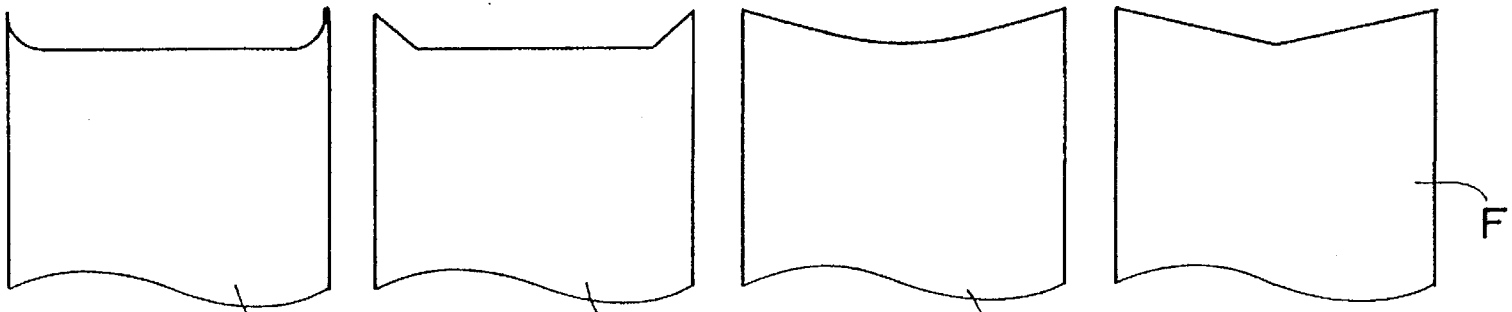
FIG. 8A
FIG. 8B
FIG. 8C
FIG. 8D
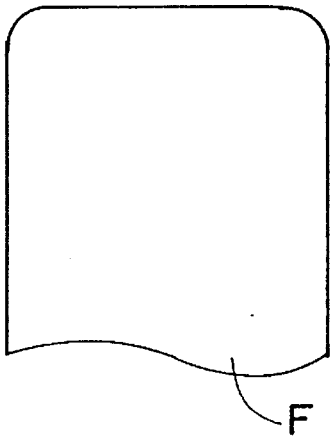
FIG. 8E
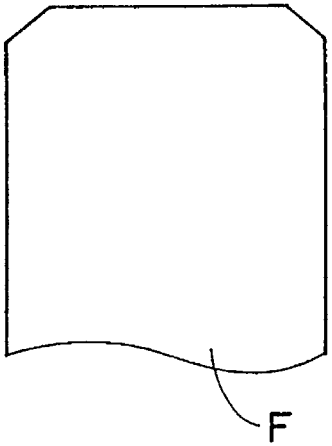
FIG. 8F
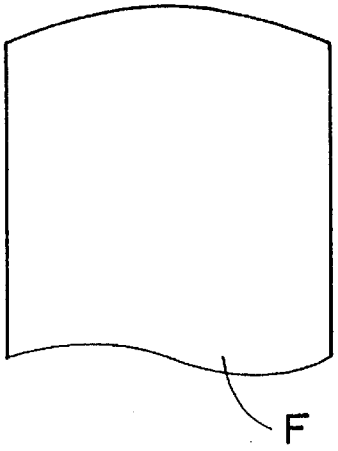
FIG. 8G
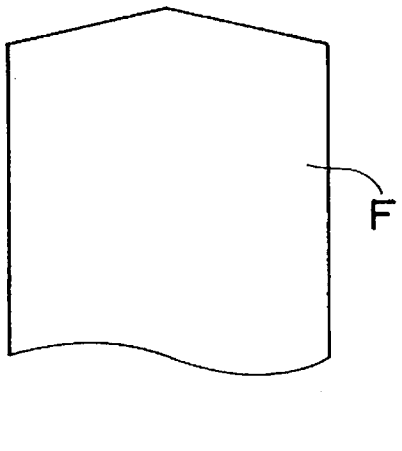
FIG. 8H

PHOTOSENSITIVE MATERIAL PROCESSING APPARATUS

BACKGROUND OF THE INVENTION

1. Field of the Invention

The present invention relates to a photosensitive material processing apparatus in which a photosensitive material is processed while being conveyed along a predetermined conveying path.

2. Description of the Related Art

In general, after the photosensitive material is exposed, respective processings such as developing, bleaching, fixing, washing, drying and the like are effected on the photosensitive material. Accordingly, the photosensitive material is nipped by roller pairs and conveyed along a predetermined path by the driving force of the roller pairs.

Here, the widths of the photosensitive materials are various. Conventionally, it has been proposed that a plurality of types of photosensitive materials having respectively different widths can be conveyed by the same apparatus.

For example, a rack for guiding the photosensitive material is disposed within a processing tank for effecting each of the above-described processings. It has been proposed that guide width changing means, which moves the edge guide of the photosensitive material in accordance with the width thereof, is provided at each of the racks (See Japanese Patent Application Laid-Open No. 1-205166).

Because the guide width changing means is a complicated mechanism, there is a drawback in that changing of the guide width in the respective processing tanks requires time and labor.

In addition, there has been proposed a structure in which a width smaller than the minimum width of the photosensitive material to be applied is nipped by the roller pairs, in which the transverse direction end portions of the photosensitive material are guided by guide grooves which are provided at the side walls of each of the processing tanks, and in which the driving rollers are disposed at predetermined places of the guide grooves (See Japanese Utility Model Publication No. 39-21664).

In the structure having the guide grooves, there is a drawback in that a proper guide in accordance with the width of the photosensitive material is not effected so that the size (width) of the photosensitive material to be conveyed is limited.

It is also considered that a plurality of guide grooves are provided at alternative paths in accordance with the width of the photosensitive materials. However, selection of the guide grooves, a structure for introducing the photosensitive material after the selection, and the like are complicated, and therefore, such structure is not preferable.

SUMMARY OF THE INVENTION

With the aforementioned in view, an object of the present invention is to obtain a photosensitive material processing apparatus in which the structure thereof is simple, the plurality of types of photosensitive materials can be reliably guided in accordance with the widths of the photosensitive materials to be conveyed, and the guide width changing operation can be easily effected.

To this end, in accordance with the present invention, there is provided a photosensitive material processing apparatus for processing a photosensitive material while conveying it along a predetermined conveying path, comprising: a plurality of roller pairs which nip the photosensitive material and form the predetermined conveying path; at least two pairs of collar portions which are formed at one roller of at least one roller pair of the plurality of roller pairs, diameters of the collar portions being larger than the diameter of the one roller, and the diameters of the collar portions being increased along the direction towards the axial direction end portion of the one roller; at least one pair of ring-shaped groove portions which are formed at the other roller of at least one roller pair, the ring-shaped groove portions being formed at locations which correspond to the collar portions other than the collar portion pair having the smallest diameter so that the collar portions can be accommodated within the ring-shaped groove portions; and bearing mechanism which supports the roller pair so that the roller pair can relatively move in the directions of approaching and separating from each other while the roller pair are kept in parallel.

In accordance with the present invention, the collar portion which corresponds to the width of the photosensitive material to be conveyed is selected. At moving means, the selected collar portion and, if any, the collar portion whose diameter is larger than that of the selected collar portion are accommodated within the groove portions.

Accordingly, the inner side end surface of the selected collar portion serves as a guide surface of the photosensitive material. Further, the photosensitive material is nipped between the circumferential surface of the collar portion whose diameter is smaller than that of the selected collar portion and the roller at which the groove portion is formed.

Accordingly, the photosensitive material receives driving force from the roller pairs and is guided and conveyed by the end surface of the selected collar portion.

Next, in a case in which the photosensitive material wider than the above-described photosensitive material is conveyed, the collar portion which corresponds to the width of the photosensitive material is selected, and the rollers are moved closer to or further from each other as described above, whereby the conveying path which is suitable for the photosensitive material to be conveyed can be formed.

It is possible to convey a plurality of types of photosensitive materials having respectively different widths, wherein the number of types of photosensitive materials corresponds to the number of collar portions. However, it is also possible that, for example, the collar portion and the roller main body are separately formed and the collar portion can be mounted on and removed from the roller or can be slid in the axial direction of the roller. In this case, provided that there are at least two pairs of collar portions, more than two types of photosensitive materials having respectively different widths can be reliably guided and conveyed.

The above and other objects, features and advantages of the present invention will become apparent from the following description and the appended claims, taken in conjunction with the accompanying drawings in which preferred embodiments of the present invention are shown by way of illustrative example.

BRIEF DESCRIPTION OF THE DRAWINGS

The invention will now be described with reference to the accompanying drawings wherein:

FIGS. 8A through 8H are plan views showing distal end configurations of the films which are applicable to the present embodiment.

DESCRIPTION OF THE PREFERRED EMBODIMENTS

Figure 1:
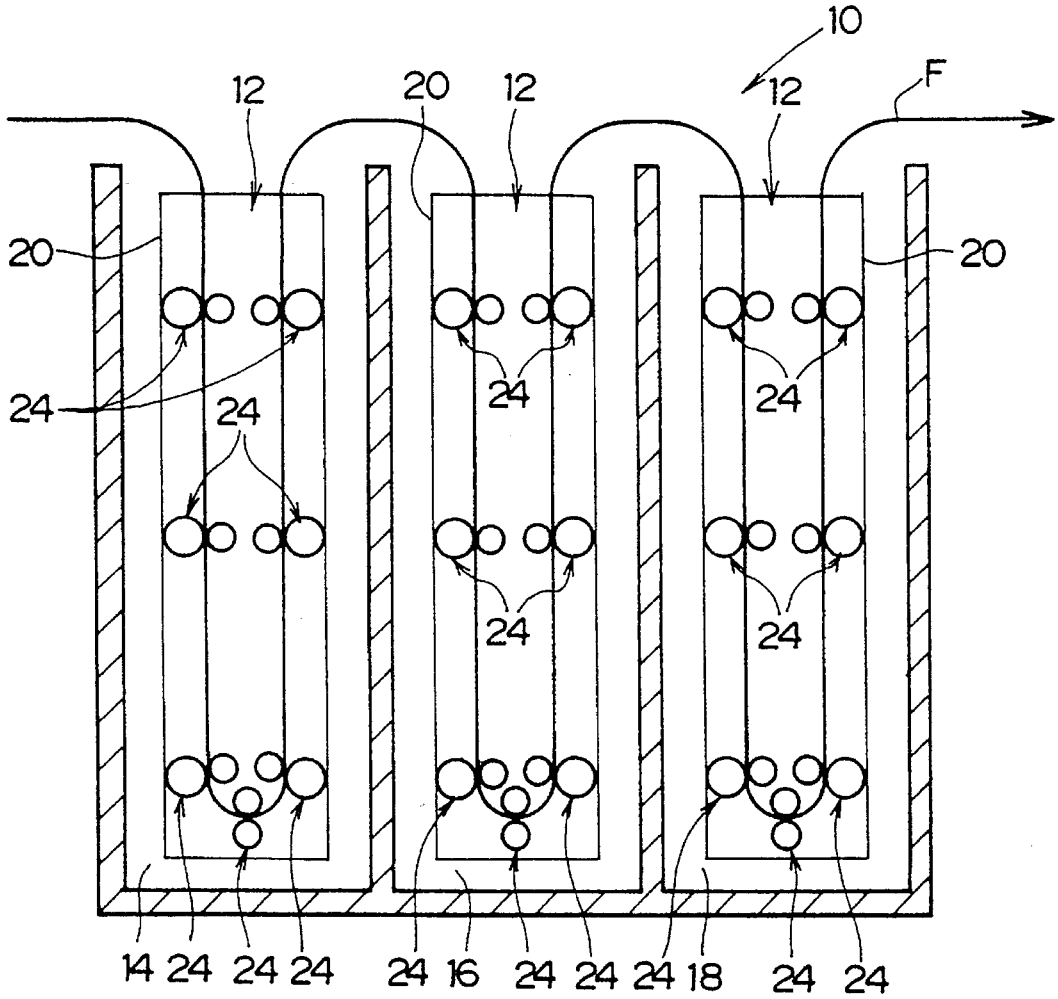
FIG. 1 is a schematic view of processing tanks of a developing apparatus relating to the present embodiment.

FIG. 1 shows an embodiment of conveying racks 12 which are applied to a developing apparatus 10 for developing a film F.

Figure 2:
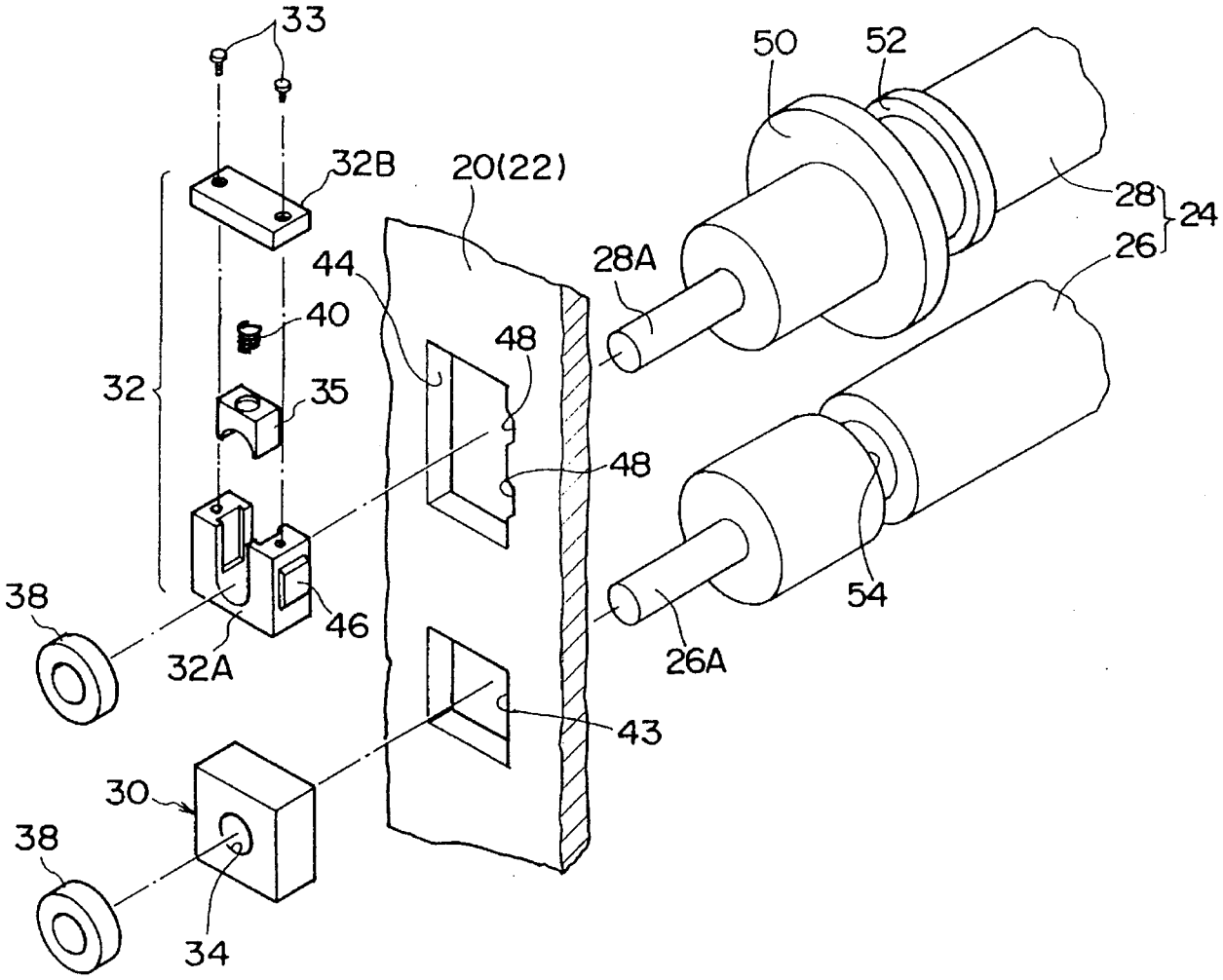
FIG. 2 is a perspective view of a side plate and the vicinity thereof.

The conveying racks 12 are immerged in respective processing tanks such as a developing tank 14, a fixing tank 16, a washing tank 18, and the like which are provided at the developing apparatus 10. A pair of side plates 20, 22 of the conveying rack 12 are held at a predetermined distance by a stay (unillustrated) so as to be parallel to each other. A plurality of roller pairs 24 are suspended between the side plates 20, 22. Namely, as illustrated in FIG. 2, rotational shafts 26A, 28A, which are provided at axial direction end portions of the roller pair 24 (rollers 26, 28), are axially supported by bearings 30, 32, which are mounted to the side plates 20, 22.

Figure 3A:
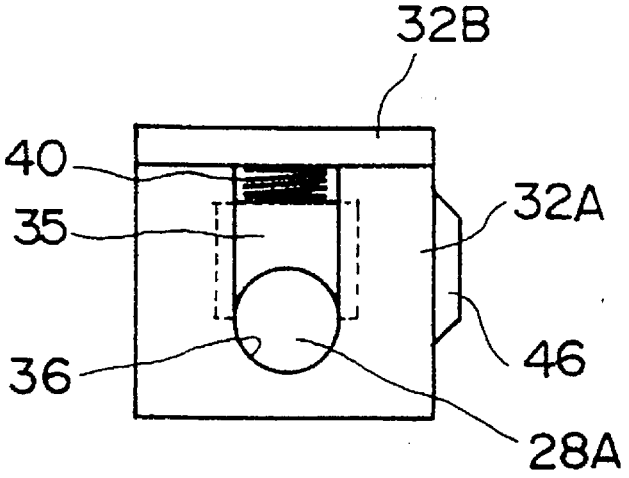
FIGS. 3A and 3B are front views of bearings.
Figure 3B:
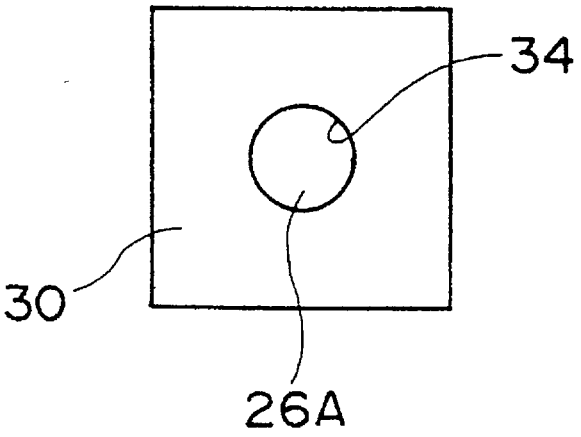

A circular hole 34 is provided in the bearing 30, which axially supports the roller 26, one of the above-described roller pair 24. On the other hand, in the bearing 32 which axially supports the other roller 28, a main body 32A and a lid body 32B are assembled by screws 33. A substantially U-shaped groove is formed at the main body 32A, and a pressing member 35 is accommodated therewithin so as to be movable. A semicircular groove is formed at the pressing member 35, and an elongated (or a circular) hole 36 (see FIG. 3A) is formed between the pressing member 35 and the main body 32A in an assembled state of the bearing 32.

A coil spring 40 (see FIG. 3A) is mounted between the pressing member 35 and the lid body 32B. Accordingly, the roller 28, which is axially supported by the elongated hole 36, is urged in the direction of approaching the roller 26. Rotating bodies 38 are provided at the end portions of the respective rotational shafts 26A, 28A so that the axial movements of the rollers 26, 28 are limited.

Here, the bearing 30 is inserted through a rectangular hole 43 (see FIG. 2) provided at the side plates 20, 22 and is completely fixed to the side plates 20, 22. However, the other bearing 32 is mounted such that the bearing 32 is movable in the direction perpendicular to the axis and along the line which passes through the axial center of the above-described bearing 30.

Namely, as illustrated in FIG. 2, a rectangular hole 44 is provided at the side plates 20, 22 and the bearing 32 is inserted through the rectangular hole 44. Accordingly, the bearing 32 is movable in one direction (the direction of long side of the rectangle).

Figure 4:
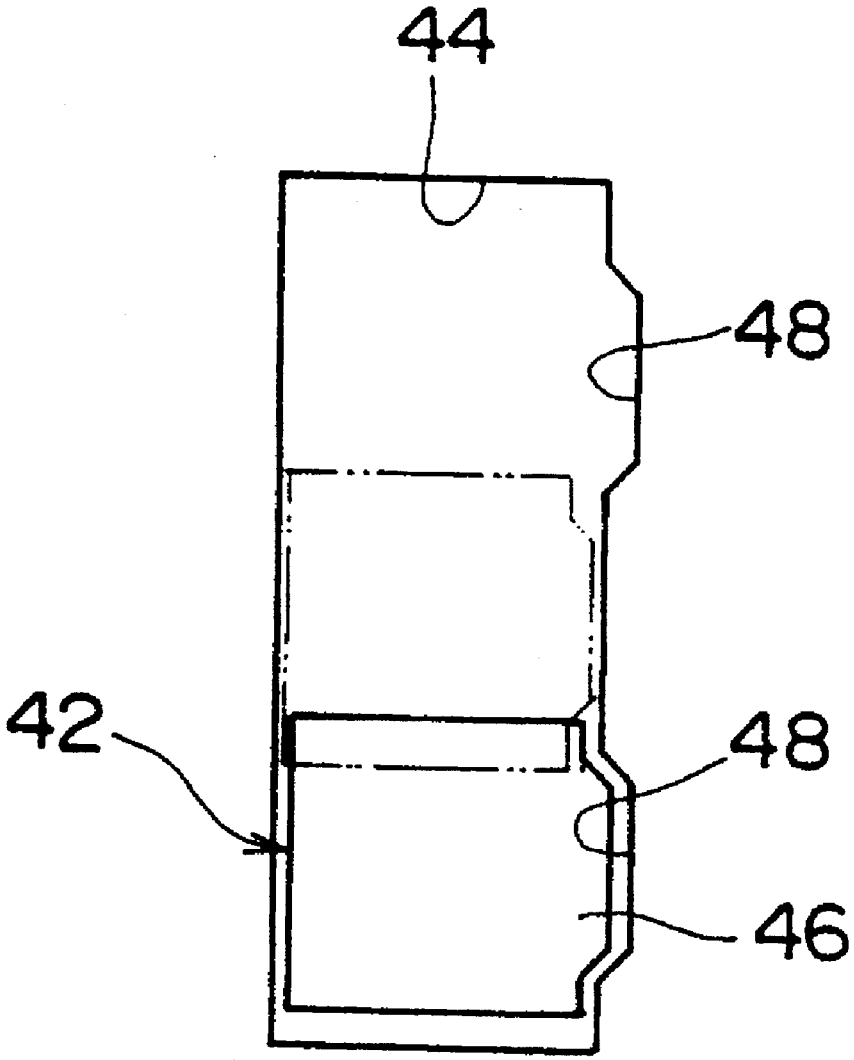
FIG. 4 is a front view of a rectangular hole provided at the side plate.

A trapezoid protruding portion 46 is formed on the side surface of the bearing 32. In correspondence with this, trapezoid concave portions 48 (see FIG. 4) are formed at the rectangular hole 44 of the side plates 20, 22. A plurality of concave portions 48 (in the present embodiment, two) are provided along the long side of the rectangular hole 44. The above-described protruding portion 46 is selectively inserted through the concave portion 48. Namely, when the bearing 32 is moved in the direction of the long side of the rectangular hole 44, the protruding portion 46 is temporarily deformed until it reaches the next concave portion 48. When it reaches the next concave portion 48, the deformation is released and the bearing 32 is retained thereat.

The moving mechanism of the bearing 32 may be effected by a solenoid or a cylinder, or may be operated manually.

Figure 5A:
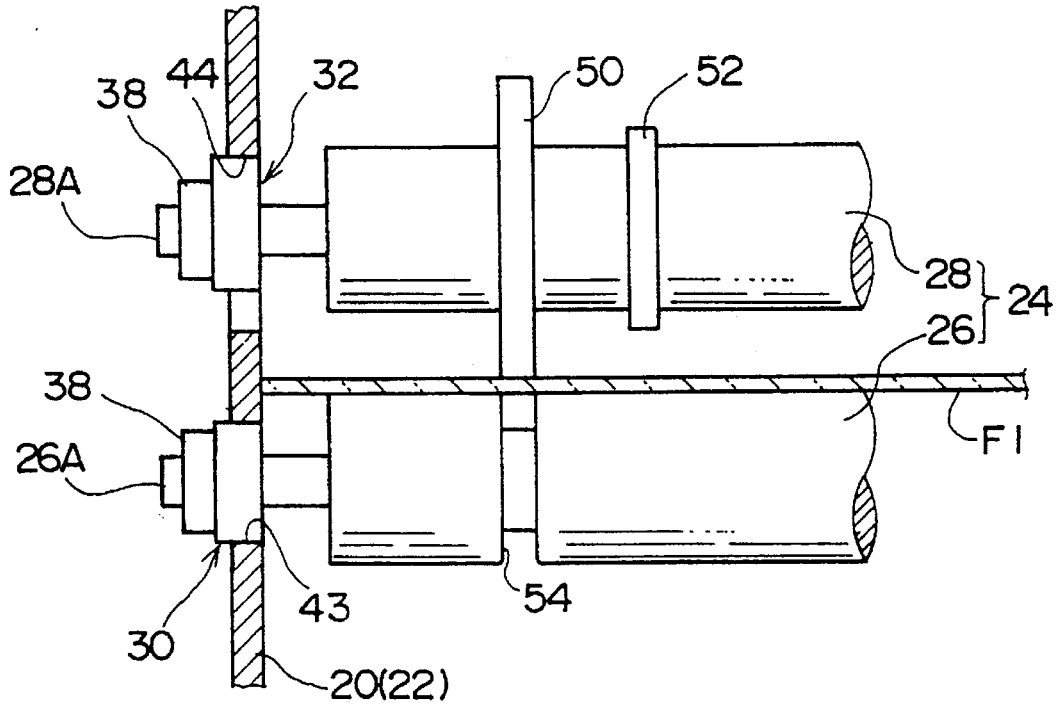
FIG. 5A is a side view of a roller pair relating to the present embodiment, showing a state in which a wide film is used.
Figure 5B:
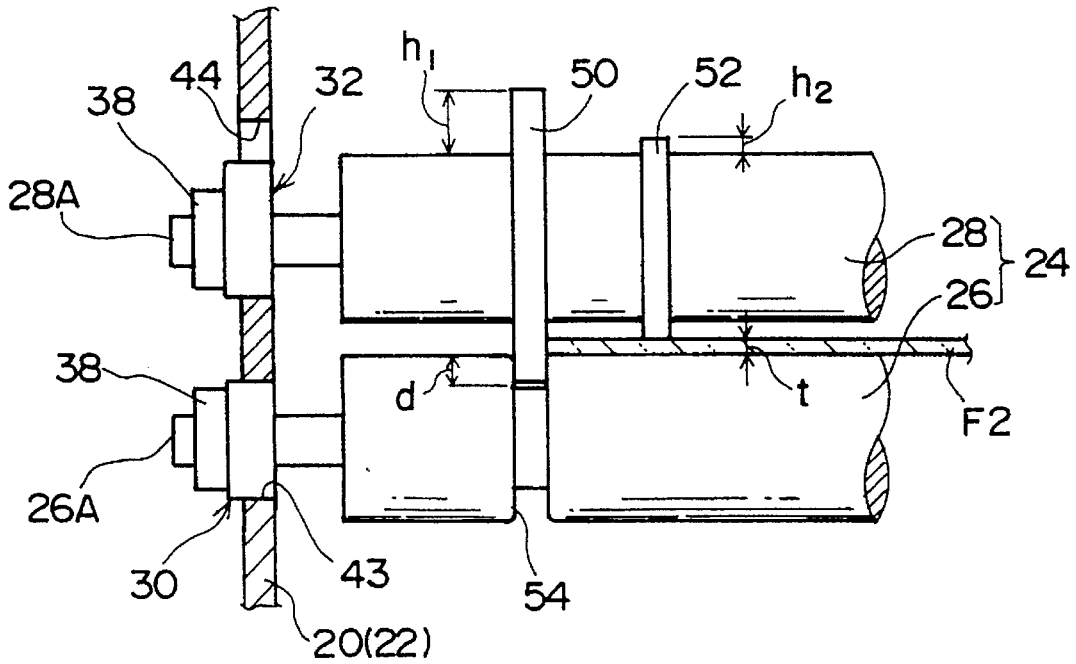
FIG. 5B is a side view of the roller pair relating to the present embodiment, showing a state in which a narrow film is used.

As illustrated in FIGS. 2, 5A and 5B, the roller 28 is provided with two pairs of collar portions 50, 52 at end portions in the axial direction thereof. The collar portions in each pair are equidistant from the center in the longitudinal direction of the roller 28. The outside diameter of the collar portion 50 in one pair is different from that of the collar portion 52 in the other pair, and the diameter of the collar portion 50 in the one pair which is located at the outer side is larger. The difference between the radius of the collar portion 50 and that of the collar portion 52 corresponds to the interval of the above-described concave portions 48.

Corresponding to the collar portion 50 having a larger diameter, a ring-shaped groove portion 54 is formed at the roller 26. As shown in FIG. 5B, the depth of the groove portion 54 is a value which satisfies a condition of $d \geqq h_1 - h_2 - t$, wherein the thickness of the conveyed film F is t, the height of the collar portion 52 from the roller 28 is $h_2$, the height of the collar portion 50 from the roller 28 is $h_1$, and the depth of the groove portion 54 is d.

Here, in the present embodiment, two types of films F having respectively different widths are processed. Namely, one is a usual film called 135 film and having a width of 35 mm (hereinafter, "film F1"), and the other is a film called 110 film and having a width of 16 mm (hereinafter, "film F2").

In case of processing the wide film F1 (135 film), the protruding portion 46, which is provided at the above-described bearing 32, is inserted through the concave portion 48 which is located further from the roller 26 (i.e., the upper concave portion 48 in FIG. 2). Accordingly, the circumferential surface of the collar portion 50 having a larger diameter is in a vicinity of an open end of the corresponding groove portion 54, that is, in a vicinity of the extension line of the circumferential surface of the roller 26.

Consequently, as shown in FIG. 5A, the film F1 can receive the driving force in a state in which the film F1 is nipped between the collar portion 50 having a larger diameter and the circumferential surface of the roller 26. The nipping force is caused by the urging force of the above-described coil spring 40. In this case, the film F1 is stably conveyed because the side plates 20, 22 serve as the width guides of the film F1 (guides for end portions of the film F1 in the transverse or width direction).

Here, in case of processing the narrow film F2 (110 film), the width guide of the film F2 is not effected in a state in which the circumferential surface of the collar portion 50 having a larger diameter is in a vicinity of an open end of the corresponding groove portion 54. Accordingly, in the present embodiment, the protruding portion 46 of the bearing 32 is moved such that the protruding portion 46 is inserted through the concave portion 48 which is located nearer to the roller 26 (i.e., the lower concave portion 48 in FIG. 2).

As shown in FIG. 5B, in this state, the collar portion 50 having a larger diameter is accommodated within the groove portion 54, and the collar portion 52 having a smaller diameter contacts the circumferential surface of the roller 26.

Therefore, the film F2 is nipped between the circumferential surface of the collar portion 52 having a smaller diameter and the roller 26, and the end surface of the collar portion 50 having a larger diameter serves as the guide for end portions of the film F2 in the transverse (or width) direction. The narrow film F2 can be thereby stably conveyed.

The operation of the present embodiment will be explained hereinafter.

The film F, onto which the images are printed by the exposure processing, is loaded into a predetermined position of the developing apparatus 10 so as to be conveyed into the apparatus 10. The processing tanks such as the developing tank 14, the fixing tank 16, the washing tank 18, and the like are disposed within the apparatus 10. The film F is guided and conveyed into the respective processing tanks in a substantially U-shape by the conveying racks 12 immerged in the processing tanks so that the respective processings such as developing, fixing and washing, and the like are effected. After the drying processing, the film F is discharged from the apparatus 10. The development processing of the film F is thereby completed.

Here, there are two types of films F having different widths to be conveyed into the apparatus 10. When the widths of the films F are different, the guide member which guides the transverse (or width) direction end portions of the film F must be changed. Namely, in a case in which the 135 film F1 and the 110 film F2 are inserted into the apparatus 10, the guide width of the film must be increased or decreased. For example, when the 135 film is conveyed, the guide width is increased.

Thus, in the present embodiment, the bearing 32 (the bearing which is held at the rectangular hole 44) is moved so that the protruding portion 46 is inserted through the concave portion 48 which is located further from the roller 26 so as to fit with this concave portion 48. Of course, if the last film which was processed is a 135 film, there is no need to move the bearing 32. The bearing 32 is moved when the last film which was processed is a 110 film and the protruding portion 46 is inserted through the concave portion 48 which is located nearer to the roller 26.

When a predetermined amount of force is applied to the bearing 32 in order to move the bearing 32, the protruding portion 46 is deformed and then removed from the concave portion 48 through which the protruding portion 46 was inserted.

When the bearing 32 is further moved and corresponds to the next concave portion 48, the deformation of the protruding portion 46 is relieved and the protruding portion 46 returns to its original shape. Thereby the protruding portion 46 fits with the next concave portion 48. In this state, the collar portion 52 is separated from the roller 26, and the circumferential surface of the collar portion 50 having a larger diameter is located on the extension line of the circumferential surface of the roller 26. Accordingly, the 135 film F1 is guided by the side plates 20, 22 and is nipped between the collar portion 50 having a larger diameter and the roller 26. The film F1 is thereby stably conveyed.

In a case in which the 110 film F2 is processed after the 135 film F1 is processed, the bearing 32 is moved so that the protruding portion 46, which is provided at the bearing 32, is inserted through the concave portion 48 which is located closer to the roller 26. Due to this movement, the collar portion 50 having a larger diameter enters into the groove portion 54, which is provided at the roller 26. In addition, the collar portion 52 having a smaller diameter contacts the circumferential surface of the roller 26 and abuts the roller 26 at a predetermined pressure due to the urging force of the coil spring 40.

Accordingly, the end surface of the collar portion 50 having a larger diameter becomes a guide surface of the film F2, and the film F2 is nipped between the collar portion 52 having a smaller diameter and the circumferential surface of the roller 26. As a result, the narrow 110 film F2 can be stably conveyed.

In the present embodiment, the rollers 26, 28 are structured such that they are moved closer to and further from each other. In addition, the collar portions 50, 52 are provided at one roller, and the ring-shaped groove portion 54 is provided at the other roller. Accordingly, with a simple structure and a simple movement setting of the one roller, the present embodiment can deal with the plurality of types of films having respectively different widths, without using an exclusive developing apparatus for each film.

Figure 6A:
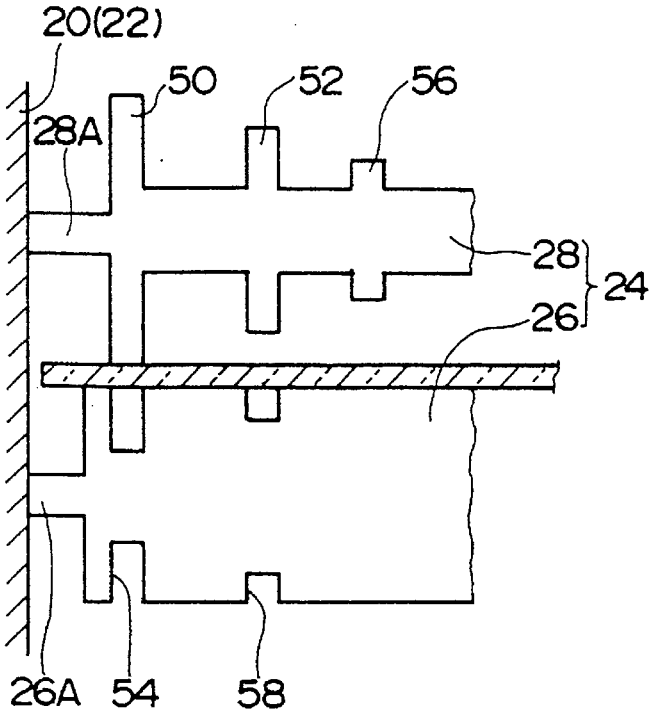
FIG. 6A is a side view of a roller pair relating to a variant example, showing a case in which the width of the film is increased.

In the present embodiment, two collar portions 50, 52 are always needed. However, the number of the collar portions is not limited, and three or more collar portions may be formed. In this case, the diameters of the collar portions must be decreased along the direction towards the longitudinal direction center of the roller 28. In addition, the number of groove portions 54 must be increased in accordance with the increase of the number of collar portions. For example, as illustrated in FIG. 6A, if three pairs of collar portions 50, 52, 56 are provided at the roller 28, groove portions 54, 58 are provided so as to correspond to the two collar portions 50, 52 at the outer side, and movement of the bearing 32 has three stages (three concave portions 48 are provided), three types of films F having respectively different widths can be stably conveyed.

Figure 7A:
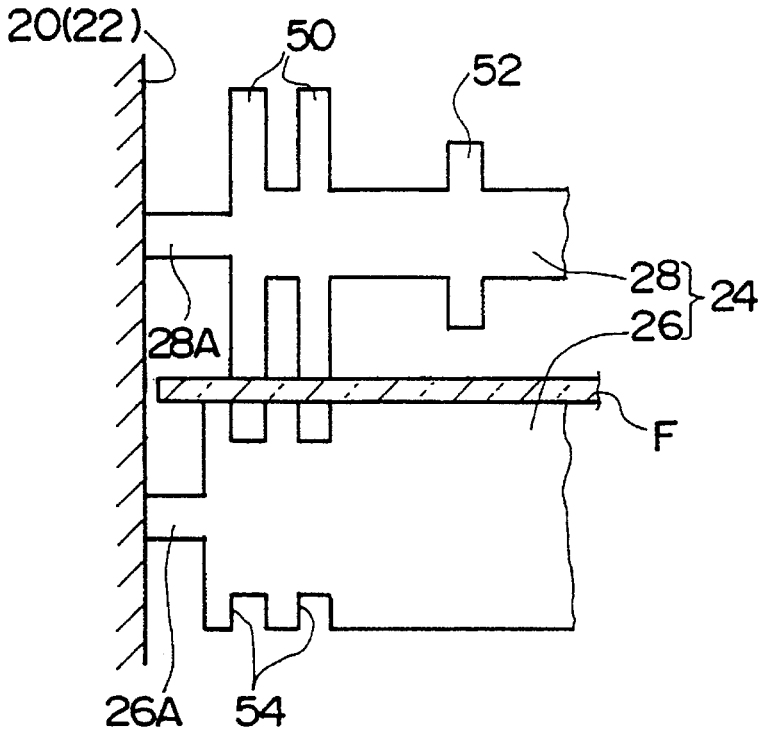
FIG. 7A is a side view of a roller pair relating to a variant example.
Figure 7B:
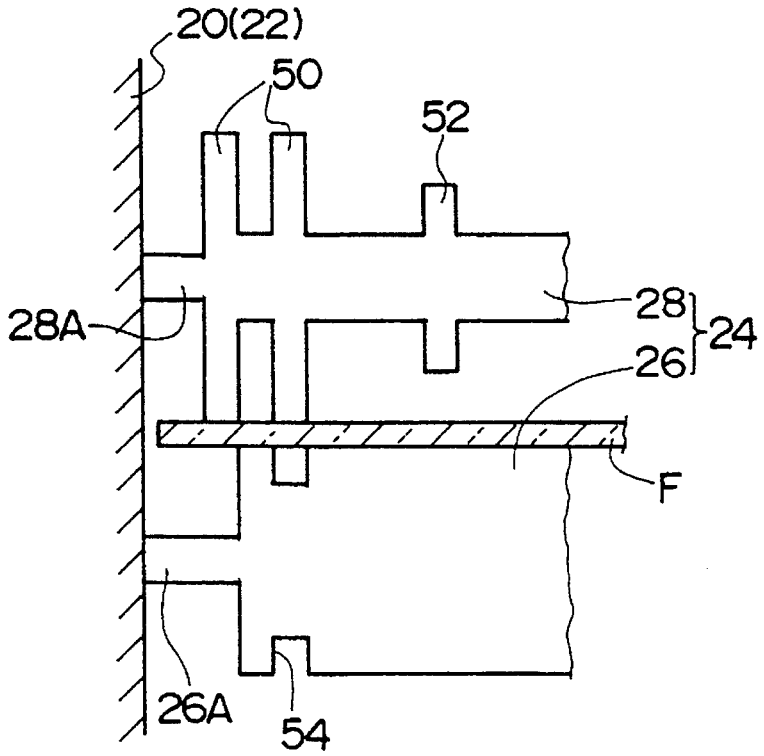
FIG. 7B is a side view of a roller pair relating to a variant example.

Moreover, as illustrated in FIGS. 7A and 7B, two pairs of collar portions 50 having the same outer diameter may be provided at the roller 28. In this case, the force which nips the film F can be dispersed, and in particular, there is a great advantage in that the film is prevented from being deformed due to the nipping force of the collar portions 50 having larger diameters (urging force of the coil spring 40 shown in FIG. 3A).

Figure 6B:
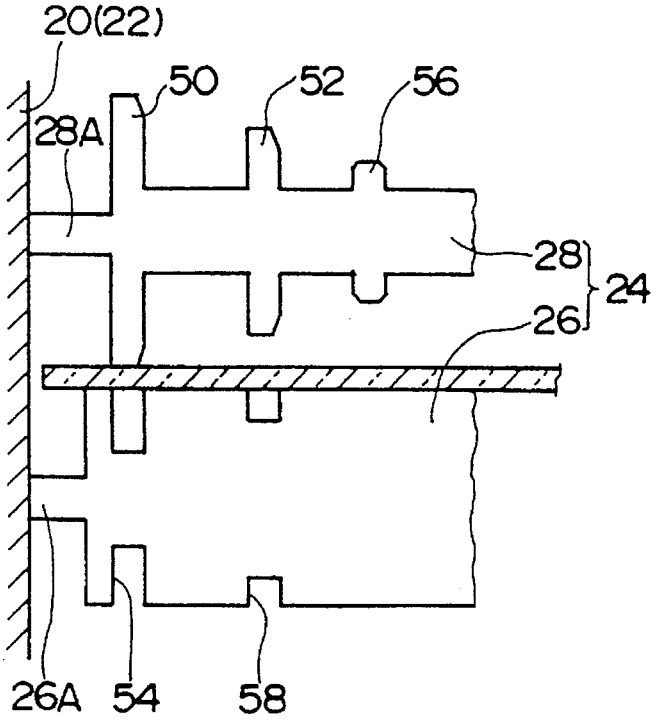
FIG. 6B is a side view of the roller pair relating to the variant example, showing a case in which a corner portion of the collar portion is chamfered.

Further, as illustrated in FIG. 6B, by chamfering or by rounding off the corner portion between the end surface and the circumferential surface of the collar portion 50, the collar portion 50 is prevented from catching on the groove portion 54 when the collar portion 50 is inserted into the groove portion 54. In addition, there is an advantage in that the film F1 smoothly enters between the collar portion 50 and the roller 26. Moreover, in a case in which the film F1 is nipped by the collar portion 50, because the film F1 is not nipped by the corner portion, a superior effect is achieved in that concave deformation of the film F1 due to the nipping pressure is prevented.

In the present embodiment, even if the distal end configuration of the film F is cut in a usual way (a linear cut which is orthogonal to the conveying direction of the film), the film F can be fully inserted between the roller pair 24. However, by having the configurations shown in FIGS. 8A through 8H (a description will be given later), the insertion of the film F becomes easier and the stability at the time of conveying the film F improves.

Namely, FIG. 8A shows a state in which the transverse direction central portion of the film F is caved in and the transverse direction end portions are rounded off (concave and round). FIG. 8B shows a state in which the transverse direction central portion of the film F is caved in and the transverse direction end portions are chamfered by tapering (concave and tapered). FIG. 8C shows a state in which the entire end surface of the film F is caved in so as to form an arc-shape (concave curved surface). FIG. 8D shows a state in which the end surface of the film F is caved in so as to form a V-shape (concave inclined surface). FIG. 8E shows a state in which the transverse direction central portion of the film F protrudes and the transverse direction end portions are rounded off (convex and round). FIG. 8F shows a state in which the transverse direction central portion of the film F protrudes and the transverse direction end portions are chamfered by tapering (convex and tapered). FIG. 8G shows a state in which the entire end surface of the film F protrudes so as to form an arc-shape (convex curved surface). FIG. 8H shows a state in which the end surface of the film F protrudes so as to form an inverted V-shape (convex inclined surface).

By effecting any one of the configurations described above, the distal end portion of the film F is gradually inserted between the roller pair 24. Accordingly, it is easy for the film F to separate the roller 28 from the roller 26 against the urging force of the coil spring 40, when the distal end portion of the film F is inserted between the roller pair 24. In the present embodiment, a description was given by using a 135 film F1 and a 110 film F2 as examples of the types of films. However, by changing the interval between the collar portions, the present invention can be applied to a film having the width other than the films in the present embodiment, such as films which are described, for example, in Japanese Utility Model Application Laid-Open No. 4-109758 and Japanese Patent Application National Publication No. 4-502518 (WO 90/04205). In this case, when the collar portion can be moved in the axial direction of the roller 28 and fixed by a screw at a predetermined position, the apparatus can be used more widely for various films. In addition, the photosensitive material is not limited to the film F and may be the other photosensitive material such as a so-called color paper.

Further, the roller pair structure of the present embodiment may be applied to all of the roller pairs of the conveying rack 12. Alternatively, the conveying rollers may be separately provided, and the roller pairs as described in the present embodiment may be intermittently disposed therebetween so that the roller pairs are used as guides.

Moreover, the axial movement of the roller 28 may be effected by the conveyed film F pushing up the roller 28.

As described above, the photosensitive material processing apparatus relating to the present invention shows superior effects in that with the simple structure thereof, a plurality of types of photosensitive materials can be reliably guided in accordance with the width of the photosensitive material to be conveyed, and the operation for changing the guide width can be easily effected.

While the embodiments of the present invention, as herein disclosed, constitute a preferred form, it is to be understood that other forms might be adopted.

What is claimed is:

1. A photosensitive material processing apparatus for processing a photosensitive material while conveying it along a predetermined conveying path, comprising:

a plurality of roller pairs which nip said photosensitive material and form said predetermined conveying path;

at least two pairs of collar portions which are formed at one roller of at least one roller pair of said plurality of roller pairs, diameters of said collar portions being larger than the diameter of said one roller, and the diameters of said collar portions being increased along the direction towards the axial direction end portion of said one roller;

at least one pair of ring-shaped groove portions which are formed at the other roller of said at least one roller pair, said ring-shaped groove portions being formed at locations which correspond to the collar portions other than the collar portion pair having the smallest diameter so that said collar portions can be accommodated within said ring-shaped groove portions; and bearing mechanism which supports said roller pair so that said roller pair can relatively move in the directions of approaching and separating from each other while said roller pair are kept in parallel.

2. A photosensitive material processing apparatus according to claim 1, wherein said bearing mechanism is attached to a pair of side plates of a conveying rack immerged in a processing tank of the photosensitive material processing apparatus.

3. A photosensitive material processing apparatus according to claim 2, wherein said bearing mechanism includes a first and a second bearing structure for rotatably supporting said one roller and said other roller of said at least one roller pair, respectively, one of said first and second bearing structure being attached to said side plates at a plurality of locations so that said roller pair can relatively move in the directions of approaching and separating from each other while said roller pair are kept in parallel, and the other of said first and second bearing structure being attached to said side plates at one location.

4. A photosensitive material processing apparatus according to claim 3, wherein said one of said first and second bearing structure includes:

a first bearing body provided with a circular hole through which a rotational shaft of the roller is inserted, and formed with a protruding portion at a side surface thereof; and a first opening provided at said side plates for movably fitting said first bearing body, and including a plurality of concave portions for selectively inserting said protruding portion of said first bearing body, and said other of said first and second bearing structure includes:

a second bearing body provided with a circular hole through which a rotational shaft of the roller is inserted; and a second opening provided at said side plates for fixedly inserting said second bearing body.

5. A photosensitive material processing apparatus according to claim 4, wherein said protruding portion of said first bearing body and said plurality of concave portions of said first opening are trapezoid.

6. A photosensitive material processing apparatus according to claim 4, wherein said first bearing body includes: a main body having a U-shaped groove formed therein and having said protruding portion formed at the side surface thereof; a pressing member formed with a semicircular groove therein, and movably accommodated within said U-shaped groove of said main body; and a lid body attached to said main body by screws for assembling said pressing member to said main body.

7. A photosensitive material processing apparatus according to claim 6, wherein said first bearing body further includes a coil spring mounted between said pressing member and said lid body for urging said one roller to a direction of approaching said other roller.

8. A photosensitive material processing apparatus according to claim 1, wherein two pairs of circular collar portions having the same outer diameter are formed at said one roller.

9. A photosensitive material processing apparatus according to claim 1, wherein a rounded surface is provided by chamfering a corner portion between an end surface and a circumferential surface of said collar portion.

10. A photosensitive material processing apparatus for processing a photosensitive material while conveying it along a predetermined conveying path between a pair of side plates of a conveying rack immerged in a processing tank, comprising:

a plurality of roller pairs which nip said photosensitive material, said plurality of roller pairs being formed between said pair of side plates so as to form said predetermined conveying path;

at least two pairs of collar portions which are formed at one roller of at least one roller pair of said plurality of roller pairs, diameters of said collar portions being larger than the diameter of said one roller, and the diameters of said collar portions being increased along the direction towards the axial direction end portion of said one roller;

at least one pair of ring-shaped groove portions which are formed at the other roller of said at least one roller pair, said ring-shaped groove portions being formed at locations which correspond to the collar portions other than the collar portion pair having the smallest diameter so that said collar portions can be accommodated within said ring-shaped groove portions;

first bearing structure for rotatably supporting said one roller of said at least one roller pair, and attached to said side plates at a plurality of locations so that said roller pair can relatively move in the directions of approaching and separating from each other while said roller pair are kept in parallel; and second bearing structure attached to said side plates at one location so as to rotatably support said other roller of said at least one roller pair.

11. A photosensitive material processing apparatus according to claim 10, wherein said first bearing structure includes:

a first bearing body provided with a circular hole through which a rotational shaft of the roller is inserted, and formed with a protruding portion at a side surface thereof;

a first opening provided at said side plates for movably fitting said first bearing body, and including a plurality of concave portions for selectively inserting said protruding portion of said first bearing body, and said second bearing structure includes:

a second bearing body provided with a circular hole through which a rotational shaft of the roller is inserted; and a second opening provided at said side plates for fixedly inserting said second bearing body.

12. A photosensitive material processing apparatus according to claim 11, wherein said protruding portion of said first bearing body and said plurality of concave portions of said first opening are trapezoid.

13. A photosensitive material processing apparatus according to claim 11, wherein said first bearing body includes: a main body having a U-shaped groove formed therein and having said protruding portion formed at the side surface thereof; a pressing member formed with a semicircular groove therein, and movably accommodated within said U-shaped groove of said main body; and a lid body attached to said main body by screws for assembling said pressing member to said main body.

14. A photosensitive material processing apparatus according to claim 13, wherein said first bearing body further includes a coil spring mounted between said pressing member and said lid body for urging said one roller to a direction of approaching said other roller.

15. A photosensitive material processing apparatus according to claim 10, wherein two pairs of circular collar portions having the same outer diameter are formed at said one roller.

16. A photosensitive material processing apparatus according to claim 10, wherein a rounded surface is provided by chamfering a corner portion between an end surface and a circumferential surface of said collar portion.

17. A photosensitive material processing apparatus for processing a photosensitive material while conveying it along a predetermined conveying path between a pair of side plates of a conveying rack immerged in a processing tank, comprising:

a plurality of roller pairs which nip said photosensitive material, said plurality of roller pairs being formed between said pair of side plates so as to form said predetermined conveying path;

at least two pairs of collar portions which are formed at one roller of at least one roller pair of said plurality of roller pairs, diameters of said collar portions being larger than the diameter of said one roller, and the diameters of said collar portions being increased along the direction towards the axial direction end portion of said one roller:

at least one pair of ring-shaped groove portions which are formed at the other roller of said at least one roller pair, said ring-shaped groove portions being formed at locations which correspond to the collar portions other than the collar portion pair having the smallest diameter so that said collar portions can be accommodated within said ring-shaped groove portions;

first bearing structure for rotatably supporting said one roller of said at least one roller pair, and attached to said side plates at a plurality of locations so that said roller pair can relatively move in the directions of approaching and separating from each other while said roller pair are kept in parallel, said first bearing structure including a first bearing body provided with a circular hole through which a rotational shaft of the roller is inserted, and formed with a protruding portion at a side surface thereof, a first opening provided at said side plates for movably fitting said first bearing body, and including a plurality of concave portions for selectively inserting said protruding portion of said first bearing body; and second bearing structure attached to said side plates at one location so as to rotatably support said other roller of said at least one roller pair, said second bearing structure including a second bearing body provided with a circular hole through which a rotational shaft of the roller is inserted, and a second opening provided at said side plates for fixedly inserting said second bearing body.

18. A photosensitive material processing apparatus according to claim 17, wherein said first bearing body includes: a main body having a U-shaped groove formed therein and having said protruding portion formed at the side surface thereof; a pressing member formed with a semicircular groove therein, and movably accommodated within said U-shaped groove of said main body; a lid body attached to said main body by screws for assembling said pressing member to said main body; and a coil spring mounted between said pressing member and said lid body for urging said one roller to a direction of approaching said other roller.

19. A photosensitive material processing apparatus according to claim 17, wherein two pairs of circular collar portions having the same outer diameter are formed at said one roller.

20. A photosensitive material processing apparatus according to claim 17, wherein a rounded surface is provided by chamfering a corner portion between an end surface and a circumferential surface of said collar portion.

* * * * *